US006905398B2

(12) United States Patent
Jeong

(10) Patent No.: US 6,905,398 B2
(45) Date of Patent: Jun. 14, 2005

(54) CHEMICAL MECHANICAL POLISHING TOOL, APPARATUS AND METHOD

(75) Inventor: In Kwon Jeong, Sunnyvale, CA (US)

(73) Assignee: Oriol, Inc., Santa Clara, CA (US)

( * ) Notice: Subject to any disclaimer, the term of this patent is extended or adjusted under 35 U.S.C. 154(b) by 0 days.

(21) Appl. No.: 09/948,676

(22) Filed: Sep. 10, 2001

(65) Prior Publication Data

US 2003/0049997 A1 Mar. 13, 2003

(51) Int. Cl.[7] ..... B24B 1/00

(52) U.S. Cl. ..... 451/57; 451/65; 451/259; 451/548; 451/461

(58) Field of Search ..... 451/57, 65, 37, 451/259, 548, 461, 398, 287, 288, 271, 66, 41; 438/692–693

(56) References Cited

U.S. PATENT DOCUMENTS 2,673,425 A * 3/1954 Karnell ..... 451/548
2,749,684 A * 6/1956 Schuhmann ..... 451/548
3,841,031 A * 10/1974 Walsh ..... 451/41
4,481,741 A * 11/1984 Bouladon et al. ..... 451/285
5,389,032 A * 2/1995 Beardsley ..... 451/359
5,503,592 A * 4/1996 Neumann ..... 451/278
5,804,507 A 9/1998 Perlov et al.
6,135,858 A * 10/2000 Takahashi ..... 451/41
6,179,690 B1 * 1/2001 Talieh ..... 451/41
6,179,695 B1 1/2001 Takahashi et al.
6,336,849 B1 * 1/2002 Konnemann ..... 451/259
6,386,956 B1 * 5/2002 Sato et al. ..... 451/57

* cited by examiner

*Primary Examiner*—George Nguyen
(74) *Attorney, Agent, or Firm*—McKenna Long & Aldridge LLP

(57) ABSTRACT

A chemical mechanical polishing tool, apparatus and method. The polishing tool includes a central polishing assembly comprised of a central pad mount on a central shaft. That central pad mount beneficially retains a center polishing pad. Also included is a ring polishing assembly comprised of a ring pad mount with a central aperture on a ring shaft with a central aperture. The ring pad mount beneficially retains a ring polishing pad having a central aperture. The central polishing assembly and the ring polishing assembly beneficially rotate and move axially independently of one another. The apparatus includes the CMP polishing tool and a rotating polishing table. The method includes rotating a semiconductor wafer on the rotating polishing table. Then, selectively and independently moving a solid center polishing pad having an axis of rotation and/or an axially aligned ring-shaped polishing pad into contact with the surface of the semiconductor wafer.

19 Claims, 6 Drawing Sheets

CHEMICAL MECHANICAL POLISHING TOOL, APPARATUS AND METHOD

BACKGROUND OF THE INVENTION

1. Field of the Invention

This invention relates to chemical mechanical polishing (CMP) used in semiconductor manufacturing. More particularly, it relates to a chemical mechanical polishing tool and to its use.

2. Discussion of the Related Art

Modern semiconductor manufacturing is a highly competitive industry that requires the ability to fabricate complex semiconductor devices at high speed, with high yields, and at low cost.

Semiconductor devices are fabricated on semiconductor wafers. Such wafers are made by carefully growing a large, high purity semiconductor crystal, which is then sliced into individual semiconductor wafers. For storage and protection the sliced semiconductor wafers are usually loaded into wafer cassettes. A wafer cassette individually stacks the sliced semiconductor wafers in slots. Wafer cassettes are beneficial in that the large numbers of semiconductor wafers can be stored and transported in a protected environment.

Unfortunately, immediately after slicing a semiconductor wafer is unsuitable for semiconductor device fabrication because the slicing leaves rough surfaces on the semiconductor wafers. Surface roughness is a serious problem because modern fabrication processes require accurate focusing of photolithographic circuit patterns onto the semiconductor wafer. As the density of the circuit patterns increases, focus tolerances better than 0.1 $\mu$meters can be required. Focusing with such small tolerances is not practical if the surface of a semiconductor wafer not highly smooth and planar.

A number of techniques for reducing semiconductor wafer surface roughness exist. A semiconductor wafer can be mechanically worked by an abrasive pad to produce a fairly smooth surface. However, as indicated above, modern semiconductor wafer surfaces must be exceptionally smooth and planar.

One technique that can suitably finish the surface of a semiconductor is Chemical-Mechanical Polishing ("CMP"). In CMP, a semiconductor wafer is mechanically and chemically worked under carefully controlled conditions. Such work is performed using a special abrasive substance that is rubbed over the surface of the semiconductor wafer. The special abrasive substance is typically a slurry that contains minute particles that abrade, and chemicals that etch, dissolve, and/or oxidize, the surface of the semiconductor wafer.

CMP is a well-known and commonly used process. As shown in FIG. 1, a conventional chemical mechanical polishing apparatus includes a mount 3 for holding and rotating a semiconductor substrate 4. That apparatus also includes a rotating disk 1 that retains a polishing pad 2. As shown, that pad has a diameter that is much larger than that of the semiconductor substrate 4. Furthermore, a nozzle 6 applies a polishing slurry 7 to the polishing pad 2.

The semiconductor substrate 4 is polished by the applied polishing slurry, by rotating the mount 3 in the direction B, by moving the mount 3 in directions C while pressing the substrate 4 against the polishing pad 2, and by rotating the polishing pad 2 in the direction A.

While the chemical mechanical polishing apparatus illustrated in FIG. 1 has been generally successful, in practice using a polishing pad 2 with a larger diameter than that of the semiconductor substrate 4 may not be optimal. For example, vibration, which can be detrimental to precise polishing, is a significant problem if a large polishing pad is rotated too fast. Thus, when using a chemical mechanical polishing apparatus similar to that illustrated in FIG. 1, the achievable polishing rate is limited. Another problem with using a large polishing pad is that since the semiconductor substrate 4 is polished over its entire surface, it is difficult to efficiently remove localized defects.

Another approach to chemical mechanical polishing is provided in U.S. patent application Ser. No. 6,179,695 B1. Referring now to FIG. 2, that patent discloses a chemical mechanical polishing apparatus having a polishing station $E_1$ that holds a semiconductor substrate W. The polishing station $E_1$ further includes a slider 104 that both rotates and horizontally moves a table 105 on a support 106. The semiconductor substrate W is placed on and held by the table 105. The slider 104 itself is on a guide table 103 on a base 101.

Also included in the chemical mechanical polishing apparatus of FIG. 2 is a polishing head $E_2$ having a plurality of polishing-tools 110. Referring now to FIGS. 2 and 3, the polishing-tools 110 are circumferentially disposed above the polishing station $E_1$. The polishing-tools 110 are mounted such that they can rotate.

Still referring to FIGS. 2 and 3, the polishing head $E_2$ also includes a revolution table 108 that is rotatably supported on a lower yoke 102*a*, which extends from a supporting member 102 that mounts on the base 101. The revolution table 108 is attached to an output shaft of a driving mechanism 107, which is supported on an upper yoke 102*b*, which extends from the supporting member 102. The driving mechanism 107 revolves the revolution table 108 at a predetermined rate, which causes the polishing-tools 110 to revolve.

The three polishing-tools 110 are interchangeable. Turning now to FIGS. 3 and 4, each polishing-tool 110 includes a plurality of ring-shaped polishing pads 111*a* and 111*b* on the end of shafts 113*a* and 113*b*. Beneficially, the polishing pads are made of a nonwoven fabric, foamed polyurethane or the like.

Referring now to FIG. 5, the outer cylindrical shaft 113*a* is bearing 115*a* mounted and rotatable with respect to a lower supporting member 108*a* (also shown in FIG. 2). The inner cylindrical shaft 113*b* is co-axially disposed within the outer cylindrical shaft 113*a*. The inner cylindrical shaft is also bearing 115*b* mounted and rotatable. The ring-shaped polishing pads 111*a* and 111*b*, which are held in position by holding members 112*a* and 112*b*, have surface areas centered at radiuses r1 and r2.

Referring now to FIGS. 2 and 5, drive mechanisms 114*a* and 114*b* (which are on the revolution table 108) connect to the cylindrical shafts 113*a* and 113*b*, respectively. Thus, the ring-shaped polishing pads 111*a* and 111*b* can be independently rotated at high speeds. The drive mechanisms 114*a* and 114*b* are controlled such that the linear velocity of the polishing pads are the same. That is, the rotational velocity of the ring-shaped polishing pads 111*a* and 111*b* are used to compensate for the different radiuses r1 and r2.

To polish a semiconductor substrate W, the ring-shaped polishing pads 111*a* and 111*b* are moved into contact at a predetermined pressure with the surface of the semiconductor substrate W. Then, the slider 104 is moved such that the semiconductor substrate W is at a polishing position. Then, the driving mechanisms 114*a* and 114*b* rotate the ring-shaped polishing pads 111*a* and 111*b* while a polishing slurry is applied to the surface of the semiconductor substrate W. At the same time, the rotating table 105 is rotated and is moved radially (with short strokes).

Since the surface being polished is polished using multiple, small diameter ring-shaped polishing pads it is possible to rotate the polishing pads at high speeds while very precisely polishing the surface irrespective of local defects. Additionally, the ring-shapes reduce vibration over that of a continuous polishing pad. It should also be noted that it is possible to use only one of the ring-shaped polishing pads when polishing.

Beneficially, the inner and outer ring-shaped polishing pads 111*a* and 111*b* can move axially with respect to each other. This makes it possible to adjust the relative heights of the polishing pads 111*a* and 111*b*, and to independently set the polishing pad pressures against the surface of the semiconductor substrate W. In turn, this enables pressure control such that the optimum processing pressures can be used.

While the apparatus illustrated in FIGS. 2–5 is beneficial, it also may not be optimal. For example, the polishing area is relatively small, even when both polishing pads contact the semiconductor wafer W. This increases the required polishing time. Furthermore, while the apparatus illustrated in FIGS. 2–5 is believed to be effective in reducing the detrimental effects of vibration, vibration is primarily only a problem after polishing has been performed for some time. Finally, the apparatus illustrated in FIGS. 2–5 may not be the best for localized polishing as the radiuses of the polishing pads causes relatively widely separated areas to be polished.

Therefore, a new semiconductor wafer polishing apparatus, and a method of using such an apparatus, that can reduce the detrimental effects of vibration, that can polish both broad and localized areas, and that can rapidly remove material from a semiconductor wafer would be beneficial.

SUMMARY OF THE INVENTION

The principles of the present invention provide for a new polishing tool that can polish a semiconductor wafer at high speed, while reducing the detrimental effects of vibration, and while enabling both broad area and localized polishing of a semiconductor wafer.

A polishing tool that is in accord with the principles of the present invention includes a central polishing assembly comprised of a central pad mount on a central shaft. That central pad mount is capable of retaining a center polishing pad having a continuous polishing surface. The polishing tool further includes a ring polishing assembly comprised of a ring pad mount with a central aperture on a ring shaft with a central aperture. The ring pad mount is capable of retaining a ring polishing pad having a central aperture. The central polishing assembly and the ring polishing assembly are fabricated such that the central polishing assembly can move in an axial direction relative to said ring polishing assembly, and such that the central shaft is disposed within the apertures of the ring assembly.

Beneficially, the polishing assembly and the central polishing assembly are both rotatable and axially movable independent of one another. Furthermore, both pad mounts beneficially retain polishing pads.

The principles of the present invention further provide for a new semiconductor wafer polishing apparatus that can polish a semiconductor wafer at high speed, while reducing the detrimental effects of vibration, and while enabling both broad area and localized polishing of a semiconductor wafer. A semiconductor wafer polishing apparatus that is in accord with the principles of the present invention includes a rotating polishing table for retaining a semiconductor wafer having a surface to be polished, and at least one polishing tool having a central polishing assembly comprised of a central pad mount on a central shaft. That central pad mount is capable of retaining a center polishing pad having a continuous polishing surface. The polishing tool further includes a ring polishing assembly comprised of a ring pad mount with a central aperture on a ring shaft with a central aperture. The ring pad mount is capable of retaining a ring polishing pad having a central aperture. The central polishing assembly and the ring polishing assembly are fabricated such that the central polishing assembly can move in an axial direction relative to said ring polishing assembly, and such that the central shaft is axially disposed within the apertures of the ring assembly.

Beneficially, the central pad mount holds a center pad, and the ring pad mount retains a ring pad. Also beneficially, the center pad and the ring pad are independently rotatable and axially movable. Furthermore, the center pad and the ring pad are beneficially mounted such that they can move across a surface of semiconductor wafer retained on the rotating polishing table. Also beneficially, a nozzle is provided for supplying a polishing slurry onto a surface of semiconductor wafer retained on the rotating polishing table. Preferably, a ring-shaped rim surrounds the polishing table. The rim provides a reference plane when polishing a semiconductor wafer.

The principles of the present invention further for a new method of polishing a semiconductor wafer. That method includes rotating a semiconductor wafer on a rotating polishing table such that a surface to be polished is exposed. Then, selectively and independently moving a solid center polishing pad having an axis of rotation and/or an axially aligned ring-shaped polishing pad into contact with the surface of the semiconductor wafer. Furthermore, the center polishing pad and/or the ring-shaped polishing pad are beneficially swept across a semiconductor wafer being polished.

Additional features and advantages of the invention will be set forth in the description and figures that follow, and in part will be apparent from that description and figures, or may be learned by practice of the invention.

BRIEF DESCRIPTION OF THE DRAWING

The accompanying drawings, which are included to provide a further understanding of the invention and which are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an illustrated embodiment of the present invention, the example of which is shown in the accompanying drawings. The principles of the present invention provide for both rapid, broad area polishing, and for localized area polishing of a semiconductor wafer. Consequently, the polishing rate can be increased, the polishing finish can be improved, and the detrimental effects of vibration can be avoided.

Figure 5:
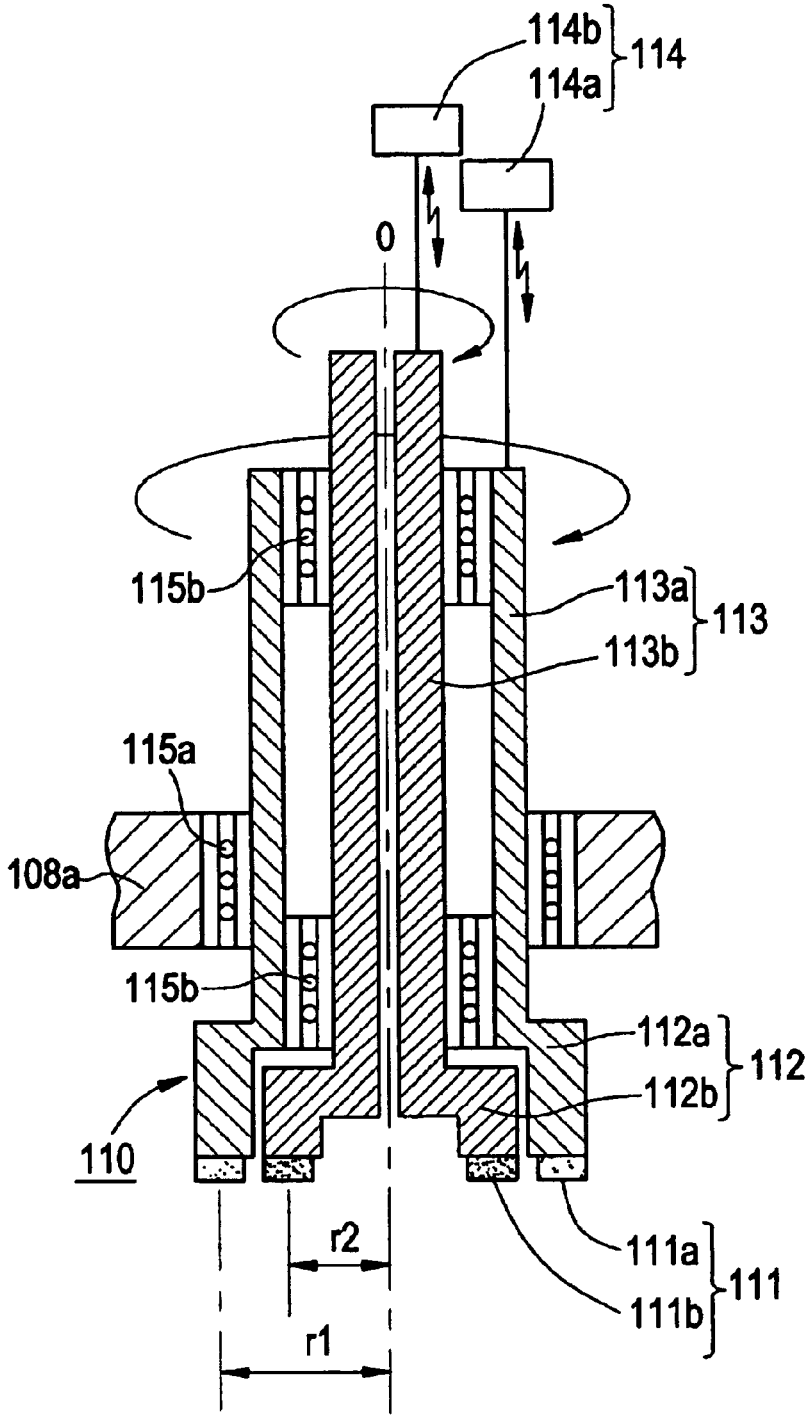
FIG. 5 RELATED ART
FIG. 5 is a schematic cross-sectional view of a polishing-tool of the chemical mechanical polishing apparatus of FIG. 2.
Figure 6:
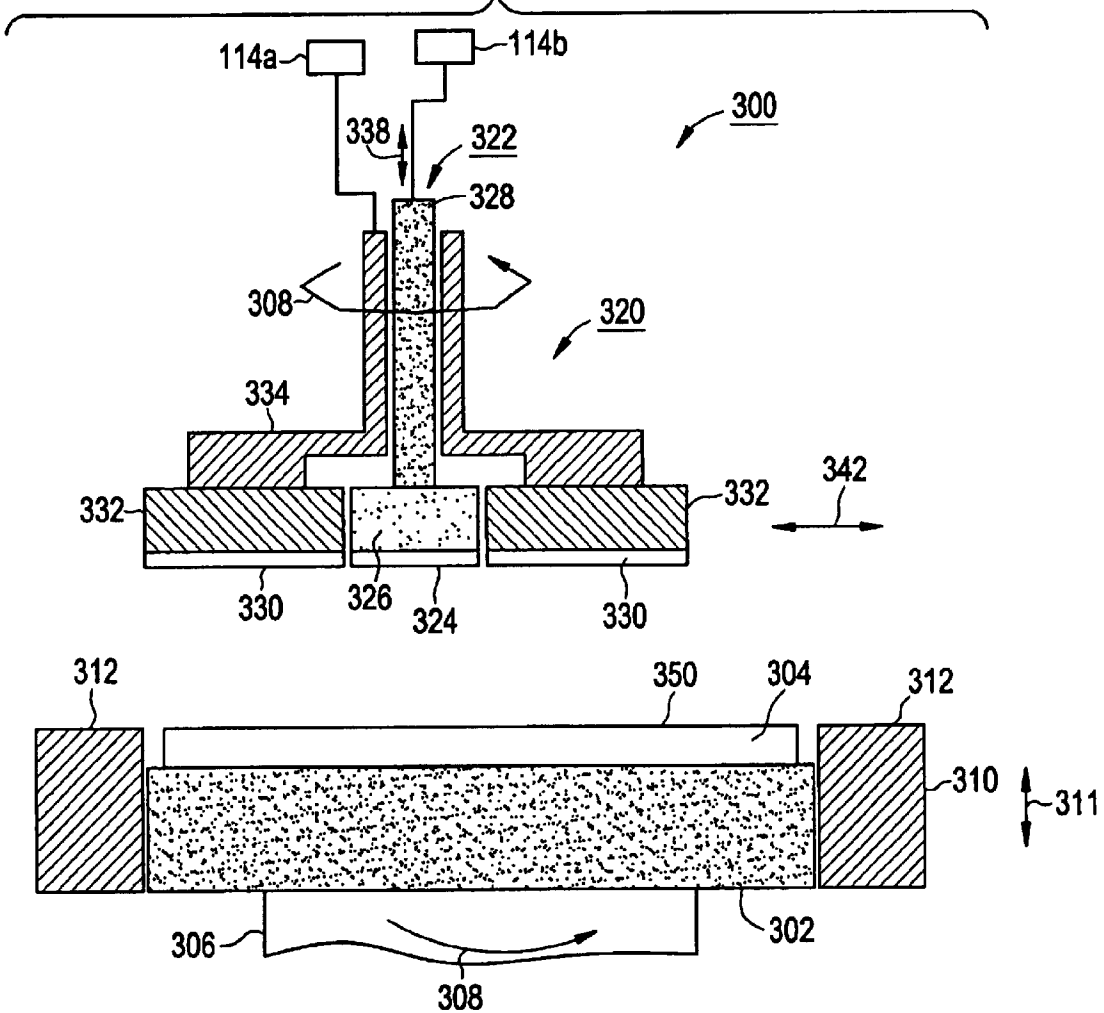
FIG. 6 is a schematic cross-sectional view of a chemical mechanical polishing apparatus that is in accord with the principles of the present invention.
Figure 7A:
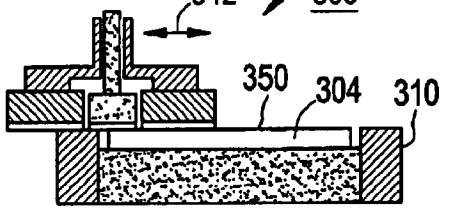
FIG. 7 illustrates a method of polishing a semiconductor wafer that is in accord with the principles of the present invention.
Figure 7B:
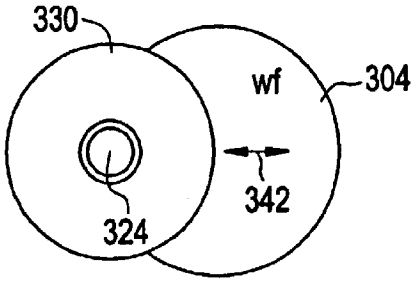
Figure 7C:
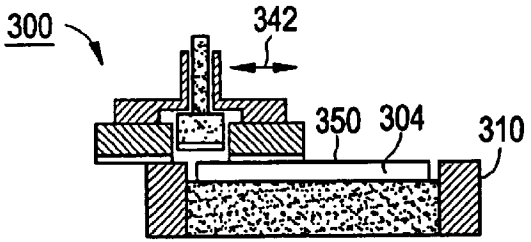
Figure 7D:
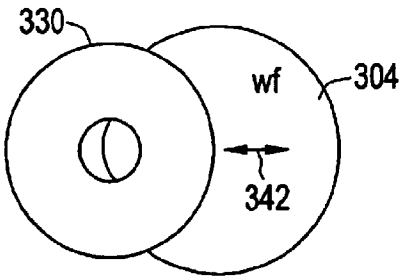
Figure 7E:
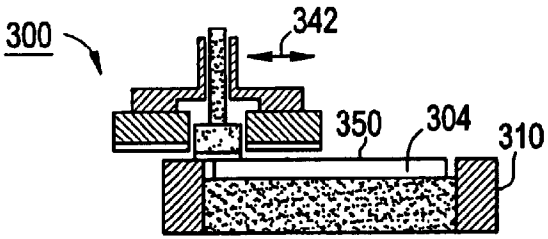
Figure 7F:
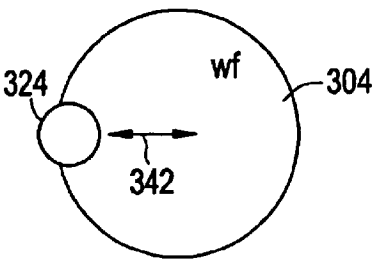

FIG. 6 schematically illustrates a simplified chemical mechanical polishing apparatus 300 that is in accord with the principles of the present invention. That apparatus includes a rotatable polishing table 302 capable of retaining, holding, and rotating a semiconductor substrate 304 that is to be polished. The polishing table is mounted on a shaft 306 that turns in the direction 308. It should be understood that the chemical mechanical polishing apparatus 300 can include any of the features of the chemical mechanical polishing apparatus illustrated in FIG. 5.

Surrounding and adjacent the polishing table 302 is a ring-shaped rim 310. The relative positions of the ring-shaped rim 310 and the polishing table 302 beneficially can be adjusted along directions 311 such that the surface 350 of the semiconductor substrate 304 is level with the top 312 of the rim 310.

Figure 2:
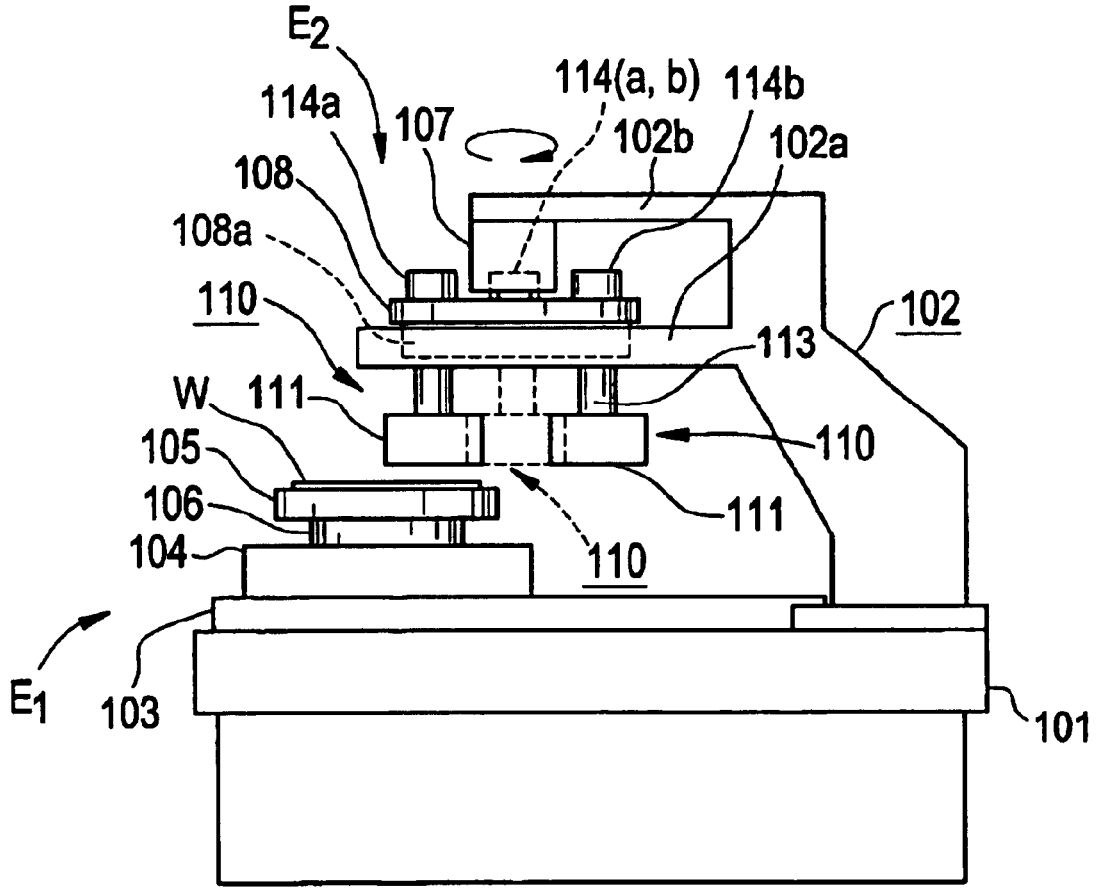
FIG. 2 RELATED ART
FIG. 2 a schematic view illustrating a related art chemical mechanical polishing apparatus.
Figure 3:
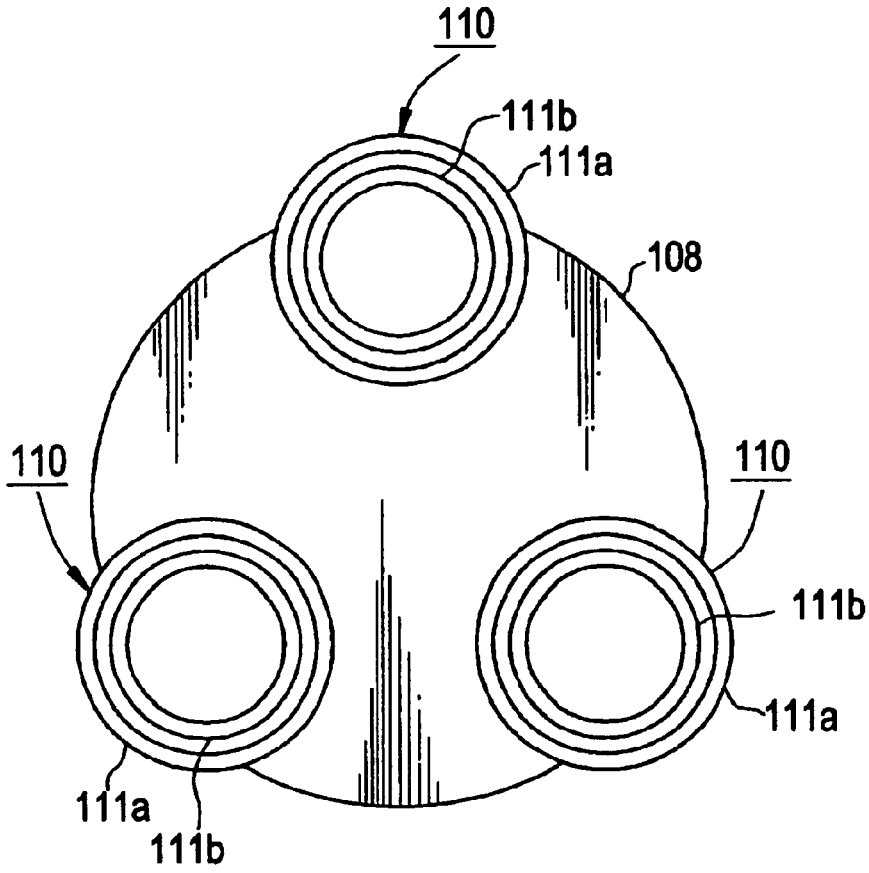
FIG.3 RELATED ART
FIG. 3 illustrates the relationship between a revolution table and the polishing-tools of the chemical mechanical polishing apparatus of FIG. 2.
Figure 4:
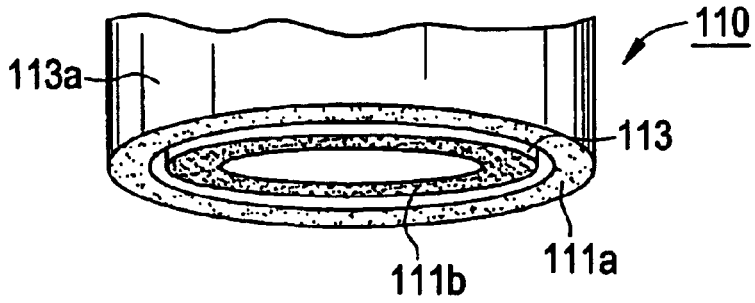
FIG.4 RELATED ART
FIG. 4 is a perspective view of the lower end of a polishing-tool of the chemical mechanical polishing apparatus of FIG. 2.

The chemical mechanical polishing apparatus 300 further includes a polishing tool 320. That polishing tool is distinct from the polishing tools of the chemical mechanical polishing apparatus illustrated in FIGS. 2 and 5. The polishing tool 320 includes a central polishing assembly 322 that includes a center polishing pad 324 on a central mount 326 that is on the end of a central shaft 328. The polishing tool 320 further includes at least one coaxially disposed ring pad 330 on a ring mount 332 of a ring shaft 334.

Figure 1:
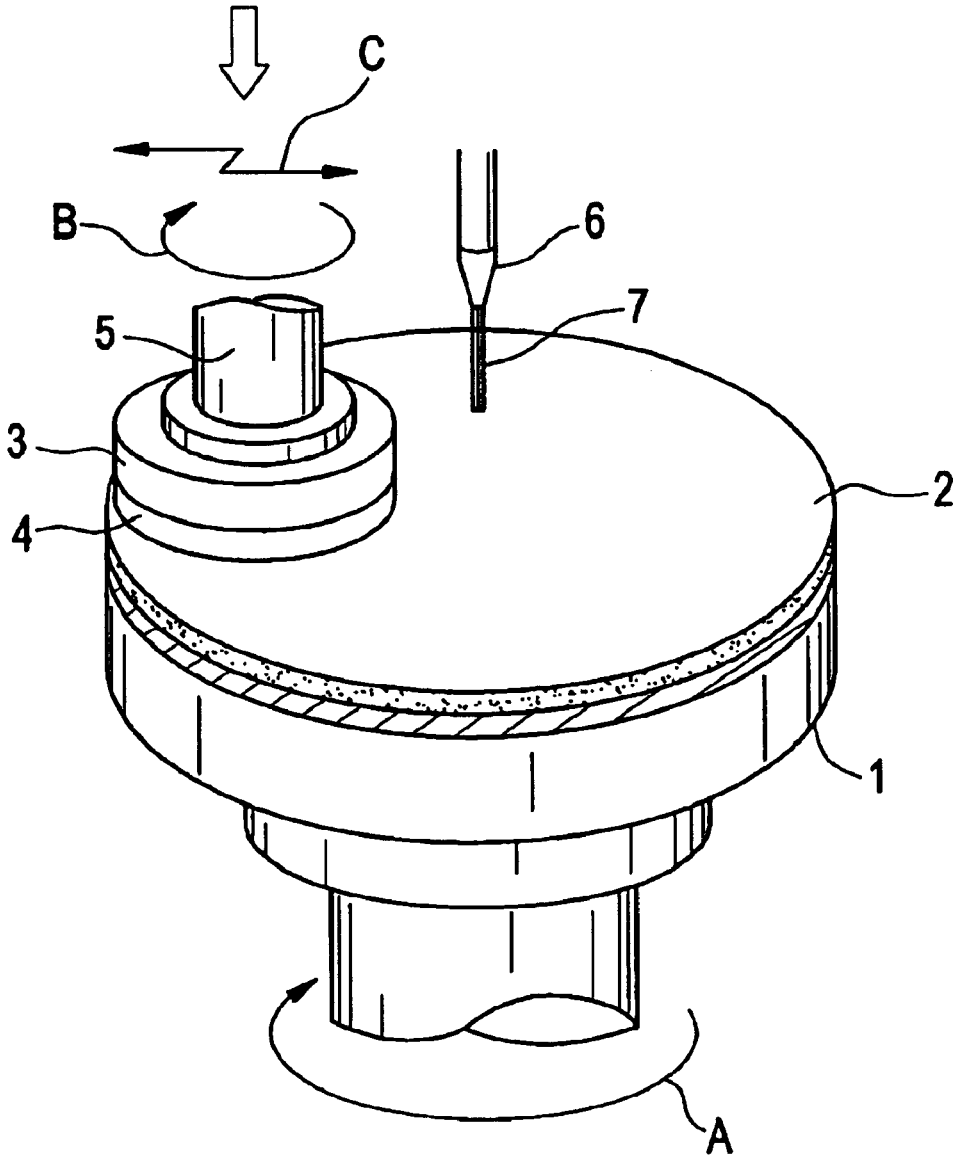
FIG. 1 RELATED ART
FIG. 1 a schematic view illustrating a conventional related art chemical mechanical polishing apparatus.

As shown in FIG. 6, the central shaft 328 is centrally disposed within the ring shaft 334. Further, those shafts share the same axis of rotation. The central shaft 328 and the ring shaft 334 are capable of independent rotation in the direction 308. Furthermore, the central shaft 328 and the ring shaft 334 are also capable of independent motion in the directions 338. Motion in the directions 308 and 338 can be provided by any suitable means (which are not shown in FIG. 6), including the driving mechanisms 114*a* and 114*b* of FIG. 5, and those suggested with regard to FIGS. 1, and 2. Furthermore, a linear driving mechanism (which is also not shown) moves the polishing head 320 relative to the polishing table 302 in the directions 342 such that the polishing pads 324 and 330 can selectively and controllably move across the semiconductor wafer 304.

As provided for above, the chemical mechanical polishing apparatus 300 is capable of multiple degrees of motion. First, the polishing table 302 rotates in the direction 308. For simplicity, this can be performed at a constant rotational velocity. Furthermore, the center polishing pad 324 and the rim polishing pad 330 can be rotated independently and with different rotational velocities in the direction 308. Those pads can also be moved independently in the directions 338. This enables each polishing pad to be brought into contact with the surface 350. Additionally, the center polishing pad 324 and the rim polishing pad 330 can be moved in the directions 342 relative to the semiconductor wafer 304. Finally, the relative position of the semiconductor wafer 304 and the top 312 of the rim 310 can be controlled. Thus, the center polishing pad 324 and the rim polishing pad 330 can be independently brought into contact with, and swept across the surface 350 of the semiconductor wafer 304. Furthermore, the rim 310 can control and even out the pressure applied to the outer perimeter of the semiconductor wafer 304.

FIG. 7 illustrates various methods of using the chemical mechanical polishing apparatus 300. As shown in FIG. 7(*a*), a cut-away view, and in FIG. 7(*b*), a top down view of the polishing pads 330 and 324, both the center polishing pad 324 and the ring polishing pad 330 can be brought into contact with the surface 350 of a semiconductor wafer 304. As may be seen with reference to FIGS. 7(*a*) and 7(*b*), the polishing pad 324 has a solid polishing surface which extends across a diameter of the polishing pad 324. The center polishing pad 324 and the ring polishing pad 330 are beneficially aligned horizontally and moved together across the surface 350 in the directions 342. The rim 310 provides a leveling reference plane for the surface 350. Since both polishing pads contact the semiconductor wafer, the polishing pads remove the maximum amount of material from the semiconductor wafer.

Turn now to FIG. 7(*c*), a cut-away illustration, and to FIG. 7(*d*), a top down illustration, for views that depict only the ring polishing pad 330 being brought into contact with the surface 350 of a semiconductor wafer 304. Such can occur when only localized polishing away from the rim of the semiconductor wafer 304 is desired. Other reasons to use only the ring polishing pad 330 include reducing vibration when polishing at high speed, and when the center polishing pad 324 is defective. As shown in FIGS. 7(*c*) and 7(*d*), the ring polishing pad 330 moves across the surface 350 in the directions 342, while the rim 310 provides a reference plane for the surface 350.

Turn now to FIG. 7(*e*), a cut-away illustration, and to FIG. 7(*e*), a top down illustration, for views that depict only the center polishing pad 324 being brought into contact with the surface 350 of a semiconductor wafer 304. Such is beneficial when localized polishing near the rim of the semiconductor wafer 304 is desired. Another reason to use only the center polishing pad 324 is when the ring polishing pad 330 is defective. As shown in FIGS. 7(*e*) and 7(*f*), the center polishing pad 324 moves across the surface 350 of the semiconductor wafer 304 in the directions 342. The rim 310 provides a leveling reference for the surface 350 when localized polishing near the rim of the semiconductor wafer 304 is being performed.

The chemical mechanical polishing apparatus 300 illustrated in FIGS. 6 and 7(*a*)–7(*f*) is a simplified depiction of a practical apparatus. In practice, various mechanisms that provide the required motion, and various controllers to control such motion, will be included. Furthermore, a mechanism to supply a polishing slurry and a mechanism to retain the semiconductor wafer on the polishing table 302 should be understood as being included. In fact, the CMP apparatus illustrated in FIG. 5, but which includes the inventive polishing tool, is a practical CMP apparatus. In any event, the additional components and mechanisms are well-known in chemical mechanical polishing systems.

While the present invention has been described with respect to illustrated embodiments, it is to be understood that the present invention is not limited to those embodiments. Furthermore, it will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. A polishing tool for polishing a semiconductor wafer, comprising:

a central polishing assembly comprised of a central pad mount on an end of a central shaft, wherein said central pad mount is configured to retain a center polishing pad having a solid polishing surface extending continuously across the diameter of said center polishing pad; and a ring polishing assembly comprised of a ring pad mount with a central aperture on a ring shaft with a central aperture, wherein said ring pad mount is configured to retain a ring polishing pad having a central aperture;

wherein said central polishing assembly and said ring polishing assembly are co-axially aligned, wherein said central polishing assembly can move in an axial direction relative to said ring polishing assembly, and wherein said central shaft is disposed within said central aperture of said ring shaft.

2. A polishing tool according to claim 1, wherein said central polishing assembly can rotate independently of said ring polishing assembly.

3. A polishing tool according to claim 1, wherein said central polishing assembly can move axially independently of said ring polishing assembly.

4. A polishing tool according to claim 1, further including a center polishing pad retained on said central pad mount.

5. A polishing tool according to claim 1, further including a ring polishing pad retained on said ring pad mount.

6. A chemical mechanical polishing apparatus, comprising:

a polishing table for retaining a semiconductor wafer having a surface; and at least one polishing tool disposed proximate said polishing table, said at least one polishing tool for polishing the surface of a retained semiconductor wafer, said at least one polishing tool including:

a central polishing assembly comprised of a central pad mount on an end of a central shaft, wherein said central pad mount is configured to retain a center polishing pad having a solid polishing surface extending continuously across the diameter of said center polishing pad; and a ring polishing assembly comprised of a ring pad mount with a central aperture on a ring shaft with a central aperture, wherein said ring pad mount is configured to retain a ring polishing pad having a central aperture;

wherein said central polishing assembly and said ring polishing assembly are co-axially aligned, wherein said central polishing assembly can move in an axial direction relative to said ring polishing assembly, and wherein said central shaft is disposed within said central aperture of said ring shaft.

7. A chemical mechanical polishing apparatus according to claim 6, wherein said central polishing assembly can rotate independently of said ring polishing assembly.

8. A chemical mechanical polishing apparatus according to claim 6, wherein said central polishing assembly can move axially independently of said ring polishing assembly.

9. A chemical mechanical polishing apparatus according to claim 6, further including a polishing table rotation mechanism for rotating said polishing table.

10. A chemical mechanical polishing apparatus according to claim 6, further including a center rotation mechanism for rotating said central polishing assembly, and a ring rotation mechanism for independently rotating said ring polishing assembly.

11. A chemical mechanical polishing apparatus according to claim 6, further including a center polishing pad retained on said central pad mount.

12. A chemical mechanical polishing apparatus according to claim 11, further including a ring polishing pad retained on said ring pad mount.

13. A chemical mechanical polishing apparatus according to claim 12, further including a center axial motion mechanism for moving said center polishing pad axially, and a ring axial motion mechanism for independently moving, said ring polishing pad axially, wherein said center polishing pad and said ring polishing pad can be selectively and independently moved into contact with a surface of a semiconductor wafer retained on said polishing table.

14. A chemical mechanical polishing apparatus according to claim 12, further including a linear motion mechanism for moving said center polishing pad across a retained semiconductor wafer.

15. A chemical mechanical polishing apparatus according to claim 12, wherein said center polishing pad has an outer largest diameter that is less than an outer diameter of a surface of a semiconductor wafer retained on said polishing table.

16. A chemical mechanical polishing apparatus according to claim 6, further including a rim around and adjacent to a circumference of said polishing table, wherein said rim includes a top surface located in a reference plane, wherein said reference plane defines a desired position of a surface of a semiconductor wafer retained on said polishing table.

17. A chemical mechanical polishing apparatus according to claim 6, further including a mechanism for locating an abrasive slurry on a surface of a semiconductor wafer retained on said polishing table.

18. A method of chemical mechanical polishing a semiconductor wafer, comprising:

rotating a semiconductor wafer on a rotating polishing table such that a surface to be polished is exposed;

and selectively and independently moving a center polishing pad having an axis of rotation and an axially aligned ring-shaped polishing pad into contact with the surface of the semiconductor wafer wherein said center polishing pad has a solid polishing surface extending continuously across the diameter of said center polishing pad.

19. A method of chemical mechanical polishing a semiconductor wafer according to claim 18, further including moving a selected one of the center polishing pad and the ring-shaped polishing pad across the surface of the semiconductor wafer.

* * * * *